US006301999B1

(12) United States Patent
Garg

(10) Patent No.: US 6,301,999 B1
(45) Date of Patent: Oct. 16, 2001

(54) RATCHET WRENCH WITH FORCE BALANCED PAWL

(75) Inventor: Ajay Garg, Plano, TX (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/595,904

(22) Filed: Jun. 20, 2000

(51) Int. Cl.[7] ..... B25B 13/46
(52) U.S. Cl. ..... 81/61; 81/63
(58) Field of Search ..... 81/60, 61, 63, 81/177.7

(56) References Cited

U.S. PATENT DOCUMENTS

| | | | | |
|---|---|---|---|---|
| 207,117 | * | 8/1878 | Hammond | 81/186 |
| D. 322,203 | | 12/1991 | Kanyuck, Sr. . | |
| 1,029,271 | * | 6/1912 | Bosserman | 81/61 |
| 1,426,127 | | 8/1922 | Tuttle . | |
| 1,453,607 | | 5/1923 | Saucier . | |
| 1,868,840 | * | 7/1932 | McNaught et al. | 81/61 |
| 1,883,618 | * | 10/1932 | Dodge | 81/63 |
| 2,294,510 | | 9/1942 | Nakano . | |
| 3,186,265 | | 6/1965 | Wenturine et al. . | |
| 3,349,653 | | 10/1967 | Kaufman et al. . | |
| 3,838,614 | | 10/1974 | O'Donnell . | |
| 4,327,611 | | 5/1982 | Catanese et al. . | |
| 4,463,632 | | 8/1984 | Parke . | |
| 4,515,044 | | 5/1985 | Harstad . | |
| 4,622,870 | | 11/1986 | Shirley . | |
| 4,993,288 | | 2/1991 | Anderson et al. . | |
| 5,218,891 | | 6/1993 | Olson et al. . | |
| 5,230,263 | * | 7/1993 | Kwaka | 81/125.1 |

(List continued on next page.)

FOREIGN PATENT DOCUMENTS 2 168 634 6/1986 (GB) .

*Primary Examiner*—James G. Smith
*Assistant Examiner*—David B. Thomas

(74) *Attorney, Agent, or Firm*—Pillsbury Winthrop LLP

(57) ABSTRACT

A ratchet wrench comprises a wrench body having a handle portion and a pawl engaging surface. A ratchet gear is removably engaged with a fastener such that torque applied to the gear is transmitted to the fastener to effect rotation. The gear is mounted to the body such that the gear and the body are rotatable relative to one another about a gear axis. The gear has a plurality of gear teeth having opposing tooth surfaces. A pawl has first and second tooth engaging surfaces and a load receiving surface. The pawl is mounted to the body for pivotal movement about a pawl axis with the load receiving surface engaging the pawl engaging surface. The pawl is movable to a gear driving position wherein the first and second tooth engaging surfaces are positioned for driving engagement with respective tooth surfaces of a pair of the gear teeth. A manual force applied in a torque applying direction to the handle portion is transmitted from the body to the pawl via the engagement between the pawl engaging surface and the load receiving surface and from the pawl to the gear via the engagement between the tooth engaging surfaces and the tooth surfaces of the pair of the gear teeth so as to apply torque to the gear. In the gear driving position, a first portion of the manual force is transmitted through the pawl from the load receiving surface to the first tooth engaging surface for application to one of the gear teeth and a second portion of the manual force is transmitted through the pawl from the load receiving surface to the second tooth engaging surface for application to the other of the gear teeth with the first and second portions of the manual force being in a balanced relation with respect to the pawl axis so that the first and second portions of the manual force offset each other about the pawl axis and the pawl is compressed between the pawl engaging surfaces and the first and second tooth engaging surfaces. A biasing element is engaged with the pawl and biases the pawl to the gear driving position. A manual force applied in a ratcheting direction to the handle portion opposite the torque applying direction causes rotation of the body relative to the gear with the pawl repeatedly ratcheting over the gear teeth against the biasing of the biasing element.

7 Claims, 7 Drawing Sheets

U.S. PATENT DOCUMENTS

| | | | | |
|---|---|---|---|---|
| 5,280,740 | * | 1/1994 | Ernst | 81/177.7 |
| 5,331,869 | * | 7/1994 | Webb | 81/177.1 |
| 5,392,672 | | 2/1995 | Larson et al. . | |
| 5,454,283 | | 10/1995 | Stefano . | |
| 5,636,557 | | 6/1997 | Ma . | |
| 5,694,818 | | 12/1997 | Nickipuck . | |
| 5,738,192 | * | 4/1998 | Miner | 192/43.1 |
| 5,862,723 | | 1/1999 | Rowlands . | |
| 5,870,932 | | 2/1999 | Brooke . | |
| 5,878,635 | | 3/1999 | Hsieh . | |
| 5,979,274 | * | 11/1999 | Hsieh | 81/60 |
| 6,000,302 | * | 12/1999 | Chiang | 81/177.8 |

* cited by examiner

RATCHET WRENCH WITH FORCE BALANCED PAWL

FIELD OF THE INVENTION

The present invention relates to a ratchet wrench for selectively applying torque to a fastener.

BACKGROUND OF THE INVENTION

Many types of ratchet wrenches are known in the art. One known type includes a wrench body, a ratchet gear having a plurality of gear teeth radially arranged on an outer peripheral surface thereof, and a spring loaded pawl having a set of gear engaging teeth. The pawl is generally received in a slot of the wrench body with the pawl being slidable within the slot. The spring urges the pawl into engagement with the ratchet gear such that the teeth thereof engage the ratchet gear teeth. As the wrench body is manually moved in a direction to apply torque to a fastener, the pawl teeth engage the gear teeth so that movement of the wrench body is applied as torque to the ratchet gear, which in turn is transmitted to the fastener As the wrench body is moved in the opposite direction, the pawl teeth disengage from and ride over the gear teeth against the biasing of the spring in a ratcheting manner. Examples of such wrenches are disclosed in U.S. Pat. Nos. 3,186,265 and 3,838,614.

One shortcoming of these types of wrenches is that when applying torque, the engagement between the gear engagement teeth of the pawl and the ratchet gear teeth results in significant shearing forces being transmitted through the pawl. For example, in the '265 patent when torque is being applied to a fastener, a substantial amount of shear stress is generated within the pawl. Specifically, the forces applied between the pawl and the gear are at an angle with respect to the direction in which the pawl is supported, thereby tending to cantilever the pawl against its supporting surface and generating the shear stress. It is known that yielding occurs under shear at a lower value than under tension/compression. The maximum shear stress criterion says that the amount of stress required for yielding under shear is half the value required for yielding under tension/compression. As a result, the pawl must be made more robust to prevent such yield. Further, in the wrench of the '265 patent when torque is applied most of the force applied to the gear is applied to only one gear tooth. As a result, because the gear is a ring-type gear, the gear wall thickness must be increased to withstand having the force localized in one area in such a manner.

Consequently, there is a need for providing a ratchet wrench wherein the transferal of forces from the pawl to the gear is handled in a more effective manner so as to reduce the stresses in one or both of those components.

SUMMARY OF THE INVENTION

It is an object of the present invention to meet the above-described need. This objective is achieved by providing a ratchet wrench for selectively applying torque to a fastener constructed in accordance with the principles of the present invention. The wrench comprises a wrench body having a handle portion configured to be manually grasped and a pawl engaging surface. A ratchet gear is constructed and arranged to be removably engaged with the fastener such that torque applied to the gear is transmitted to the fastener to effect rotation thereof The ratchet gear is mounted to the wrench body such that the gear and the body are rotatable relative to one another about a gear axis. The ratchet gear has a plurality of gear teeth arranged on a radially outer peripheral surface thereof in circumferential relation with respect to the gear axis. Each of the teeth has opposing tooth surfaces.

The wrench comprises a pawl having first and second spaced apart tooth engaging surfaces and a load receiving surface opposite the first and second tooth engaging surfaces. The pawl is mounted to the wrench body for pivotal movement about a pawl axis with the load receiving surface thereof engaging the pawl engaging surface of the wrench body. The pawl is movable to a gear driving position wherein the first and second tooth engaging surfaces of the pawl is positioned for driving engagement with respective tooth surfaces of a pair of the gear teeth. A manual force applied in a torque applying direction to the handle portion of the wrench body is transmitted from the wrench body to the pawl via the engagement between the pawl engaging surface and the load receiving surface and from the pawl to the ratchet gear via the engagement between the tooth engaging surfaces and the aforesaid tooth surfaces of the pair of the gear teeth so as to apply torque to the gear.

The pawl is constructed and arranged with respect to the gear teeth and the pawl engaging surface such that in the gear driving position thereof a first portion of the manual force is transmitted through the pawl from the load receiving surface thereof to the first tooth engaging surface thereof for application to one of the gear teeth. A second portion of the manual force is transmitted through the pawl from the load receiving surface to the second tooth engaging surface thereof for application to the other of the gear teeth. The first and second portions of the manual force are transmitted through the pawl being in a balanced relation with respect to the pawl axis so that the first and second portions of the manual force offset each other about the pawl axis and the pawl is compressed between the pawl engaging surface and the first and second tooth engaging surfaces.

The wrench also comprises a biasing element engaged with the pawl and biasing the pawl to the gear driving position. The pawl is constructed and arranged with respect to the gear teeth such that a manual force applied in a ratcheting direction to the handle portion opposite the torque applying direction causes rotation of the wrench body relative to the ratchet gear with the pawl repeatedly ratcheting over the gear teeth against the biasing of the biasing element.

Because the first and second portions of the manual force offset one another, there is no tendency for the pawl to pivot (if it is unsupported) or bend (if it is supported) and thus the pawl is in compression with no significant shearing forces within the pawl. As a result, the pawl can be made with a smaller cross-section thus requiring less space within the wrench to be dedicated to accompanying the pawl.

In a more specific aspect of the invention, the gear has a ring-shaped wall providing the outer peripheral surface with the gear teeth. The ring-shaped wall has a fastener receiving opening defined by a plurality of fastener engaging surfaces engageable with a fastener receivable in the fastener receiving opening. Because the manual force is applied by the pawl to the pair of the gear teeth in balanced relation and not localized on one tooth, the ring-shaped wall can be made thinner than in the type of wrench disclosed in the '265 patent due to better distribution of forces.

These and other objects, features, and advantages of this invention will become apparent from the following detailed description when taken into conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings.

DETAILED DESCRIPTION OF THE INVENTION

Figure 1:
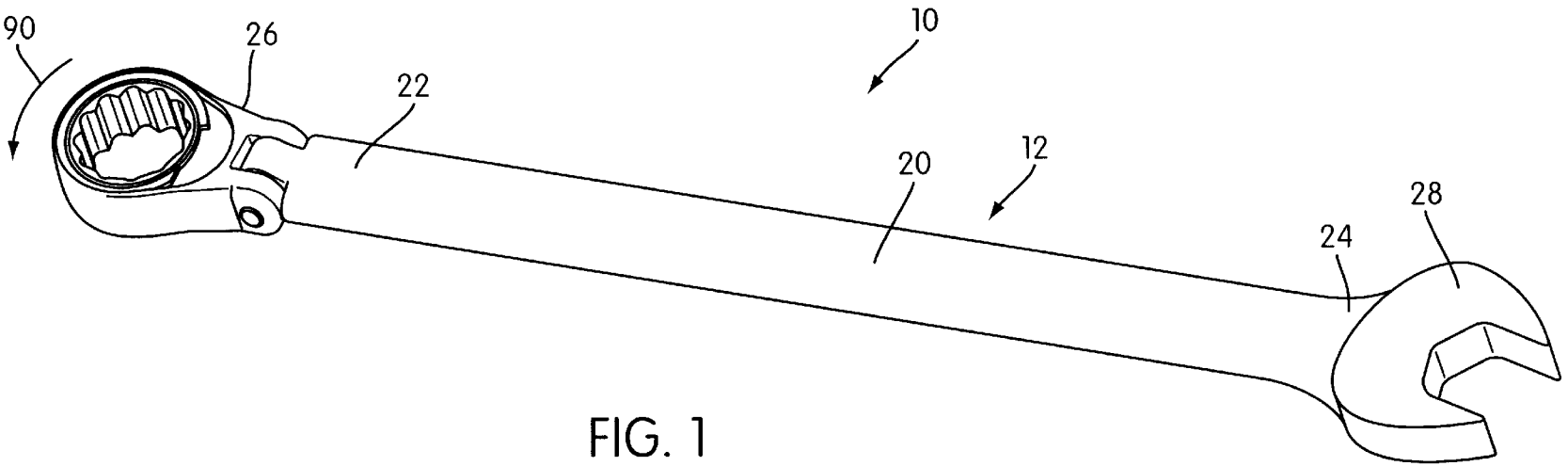
FIG. 1 is a perspective view of a ratchet wrench constructed in accordance with the principles of the present invention.
Figure 2:
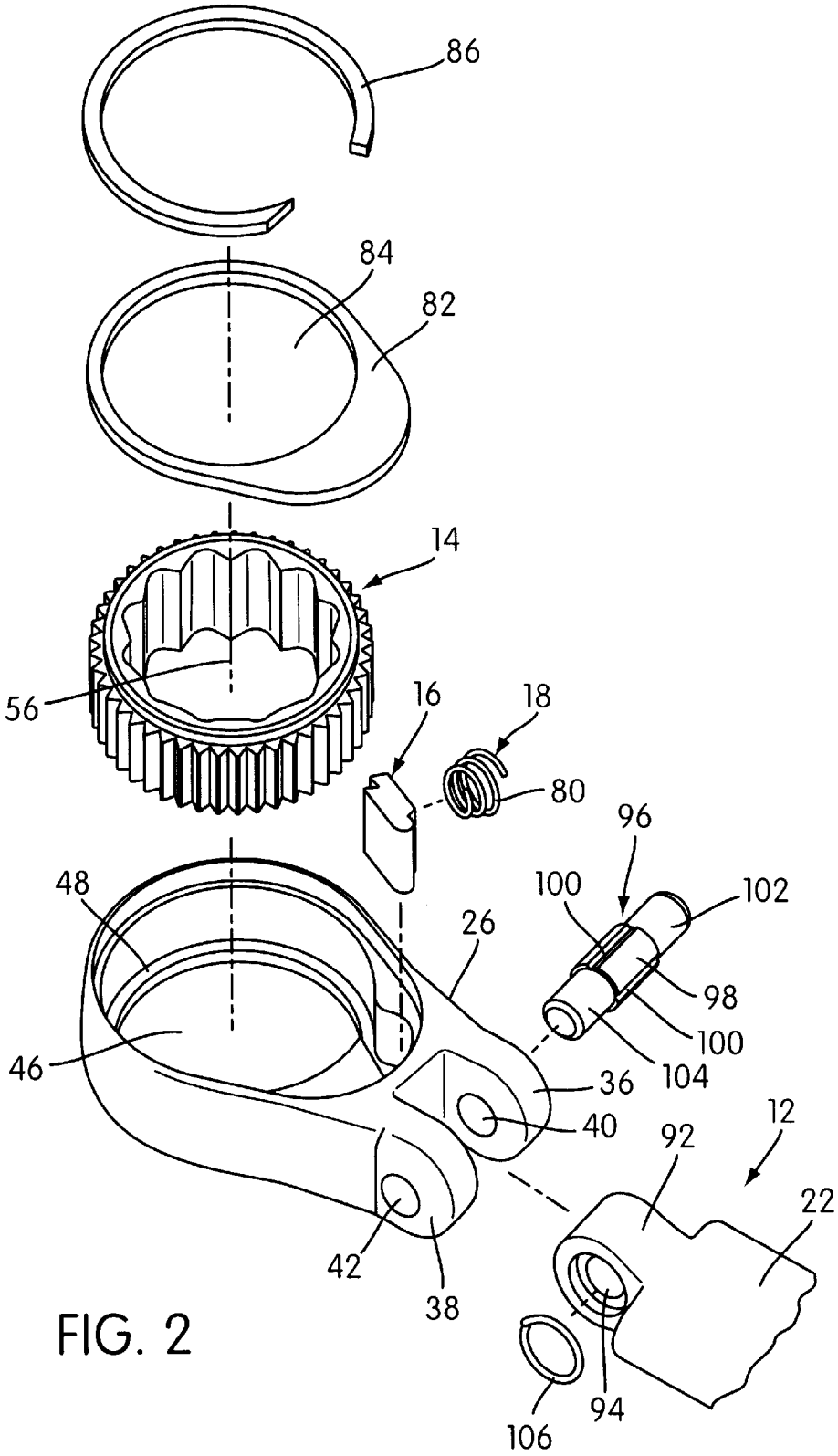
FIG. 2 is a sectional perspective exploded view of the ratchet wrench of FIG. 1.
Figure 3:
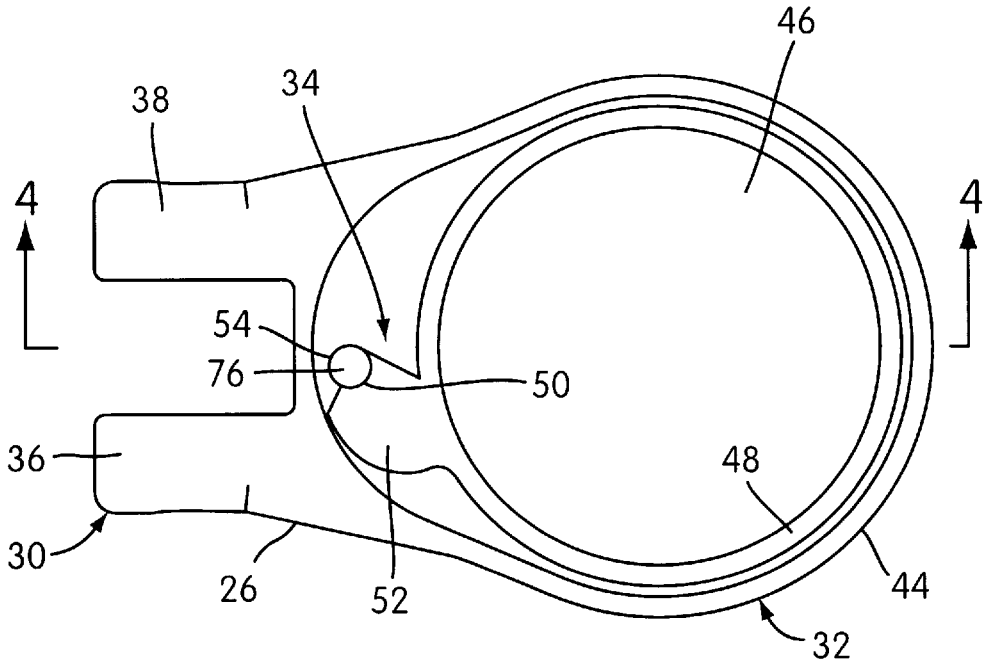
FIG. 3 is a top plan view of a gear carrier constructed in accordance with the principles of the present invention.
Figure 4:
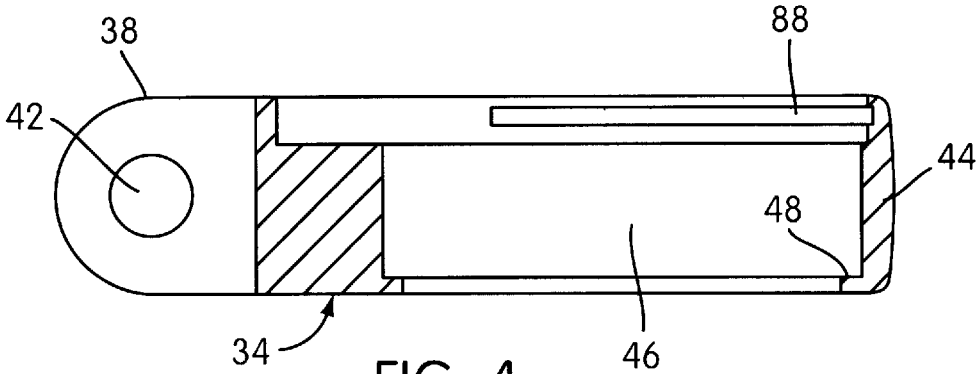
FIG. 4 is a cross-sectional view taken along line 4—4 in FIG. 3.
Figure 5:
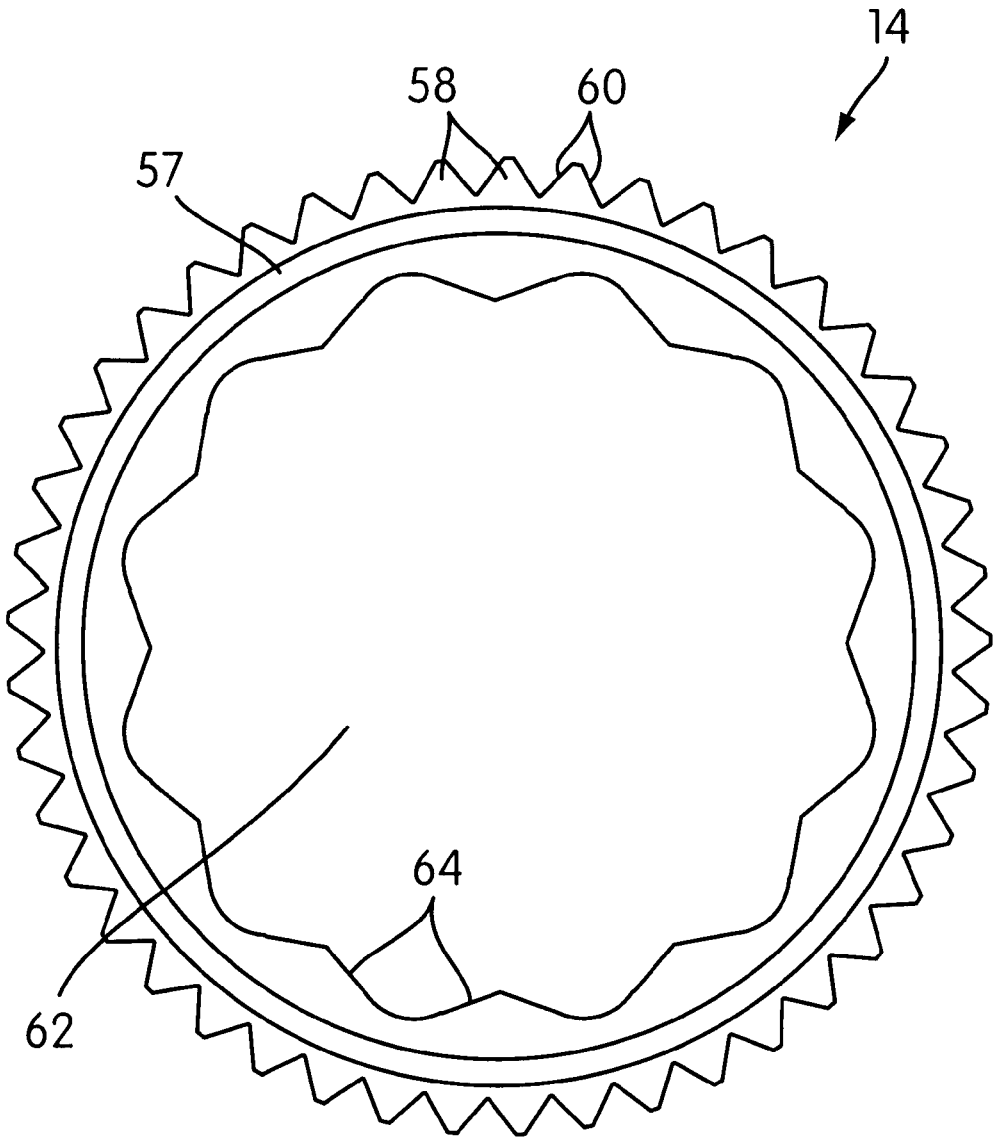
FIG. 5 is a top plan view of a ratchet gear.
Figure 6A:
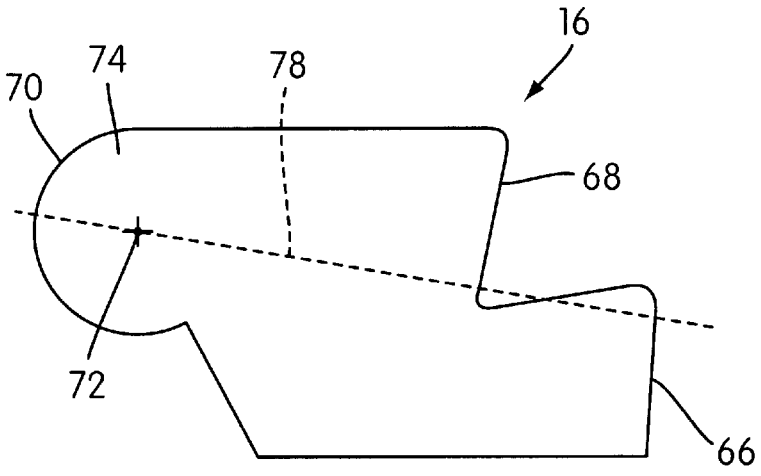
FIG. 6A is a top plan view of a pawl constructed in accordance with the principles of the present invention.
Figure 6B:
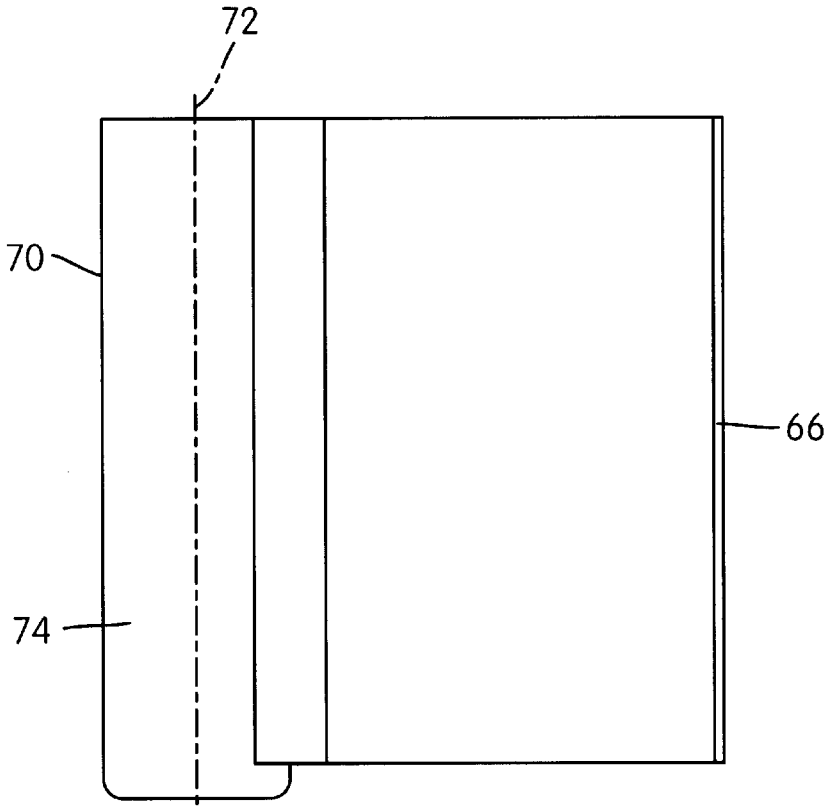
FIG. 6B is a side view of FIG. 6A.

FIG. 1 shows a ratchet wrench, generally shown at 10, for selectively applying torque to a fastener (not shown), which wrench 10 embodies the principles of the present invention. The main components of the wrench are a wrench body, generally shown at 12, a ratchet gear, generally shown at 14, a pawl, generally shown at 16, and a biasing element, generally shown at 18.

The wrench body 12 provides a handle portion 20 configured to be manually grasped. The handle portion 20 has a pair of opposing end portions 22, 24. A gear carrier 26 is pivotally mounted at one end portion 22 and an open-ended wrench head 28 is integrally formed on the other end portion 24. It is contemplated that the gear carrier 26 may be integrally formed at the one end portion 22, and thus the invention is not limited to the pivoting gear carrier 26 illustrated. It is also contemplated that any fastener engaging head member may be provided at the other end portion 24 or that the other end portion 24 is simply rounded off and no head member is provided.

The gear carrier 26 includes a handle mounting portion, generally shown at 30, a gear mounting portion, generally shown at 32, and a pawl mounting portion, generally shown at 34. The handle mounting portion 30 includes a pair of parallel arm members 36, 38 each having a transverse bore 40, 42 therethrough, which bores 40, 42 are aligned with one another. The gear mounting portion 32 includes an exterior wall 44 that defines a space 46 in which the ratchet gear 14 is to be received. A gear retaining flange 48 extends radially inwardly from the exterior wall 44. The pawl mounting portion 34 includes a pawl receiving space 50 and a biasing element receiving space 52. The pawl receiving space 50 has a pawl engaging surface 54.

The ratchet gear 14 is constructed and arranged to be removably engaged with the fastener such that torque applied to the gear 14 is transmitted to the fastener to effect rotation thereof. The ratchet gear 14 has a ring-shaped wall 57 providing an outer peripheral surface. The ring-shaped wall 57 has a fastener receiving opening 62 defined by a plurality of fastener engaging surfaces 64 that are engageable with flat driven surfaces on the head of the fastener, such as a headed bolt, received in the fastener receiving opening 62. Torque is applied to the fastener to affect rotation thereof from the gear 14 via the engagement between the fastener engaging surfaces 64 and the flat driven surfaces on the head of the fastener.

The ratchet gear 14 is rotatably mounted within the space 46 such that the gear 14 and the carrier 26 are rotatable relative to one another about a gear axis 56. The ratchet gear 14 has a plurality of gear teeth 58 arranged on the radially outer peripheral surface thereof in circumferential relation with respect to the gear axis 56. Each of the teeth 58 has opposing tooth surfaces 60. The gear teeth 58 are concealed by the exterior wall 44 of the gear carrier 26 that extends about the ratchet gear 14. The ratchet gear 14 is supported in the space 46 by the gear teeth 58 which engage against the gear retaining flange 48.

It is contemplated that the ratchet gear may alternatively be a socket-type ratchet gear which includes a solid ratchet wheel having gear teeth on the outer periphery and a square socket mounting portion extending from the center of the wheel for removably mounting a conventional socket.

The pawl 16 has first and second spaced apart tooth engaging surfaces 66, 68 and a load receiving surface 70 opposite the first and second tooth engaging surfaces 66, 68. The load receiving surface 70 of the pawl 16 has an arcuate shape. The pawl 16 comprises a generally cylindrical pivot pin 74 extending therefrom at a pawl axis 72. The pawl receiving space 52 of the gear carrier 26 comprises a generally cylindrical pivot pin receiving opening 76. The pivot pin 74 provides a portion of the pawl's load receiving surface 70 and the pivot pin receiving opening 76 provides a portion of the wrench body's pawl engaging surface 54. The pawl 16 is mounted to the gear carrier 26 for pivotal movement about the pawl axis with the load receiving surface 70 thereof engaging the pawl engaging surface 54. Thus, the pawl engaging surface 54 of the gear carrier 26 has an arcuate shape generally complementary to the arcuate shape of the load receiving surface 70 such that the surfaces 54, 70 remain engaged during pivotal movement of the pawl 16. The first and second tooth engaging surfaces 66, 68 are engaged with respective tooth surfaces 60 of a pair of the gear teeth 58. An imaginary axis 78 extends from the pawl axis 72 generally towards the first and second tooth surfaces 66, 68 and will be discussed.

The biasing element 18 is received within the biasing element receiving space 52 with one end thereof engaging a side surface of the pawl 16 and the other end thereof engaging a portion of the surface defining space 52. The biasing element 18 biases the pawl 16 to a gear driving position wherein the first and second tooth engaging surfaces 66, 68 of the pawl 16 are positioned for driving engagement with respective tooth surfaces 60 of an adjacent pair of the gear teeth 58. The biasing element 18 indicated is a spring having approximately 3.3 coils. The coils are configured so that the coils collapse and nest within itself when compressed.

A cover plate 82 including a circular hole 84 is placed in covering relation over the hole 46 opposite the gear retaining flange 48 to enclose the ratchet gear 14, the pawl 16, and the biasing element 18. The cover plate 82 is secured in place by a generally C-shaped retaining ring 86 that is received within a groove 88 of the exterior wall 44 of the gear carrier 26. As a result, the retaining flange 48 and the cover plate 82 cooperate to retain the gear 14 within the space 46.

Figure 7:
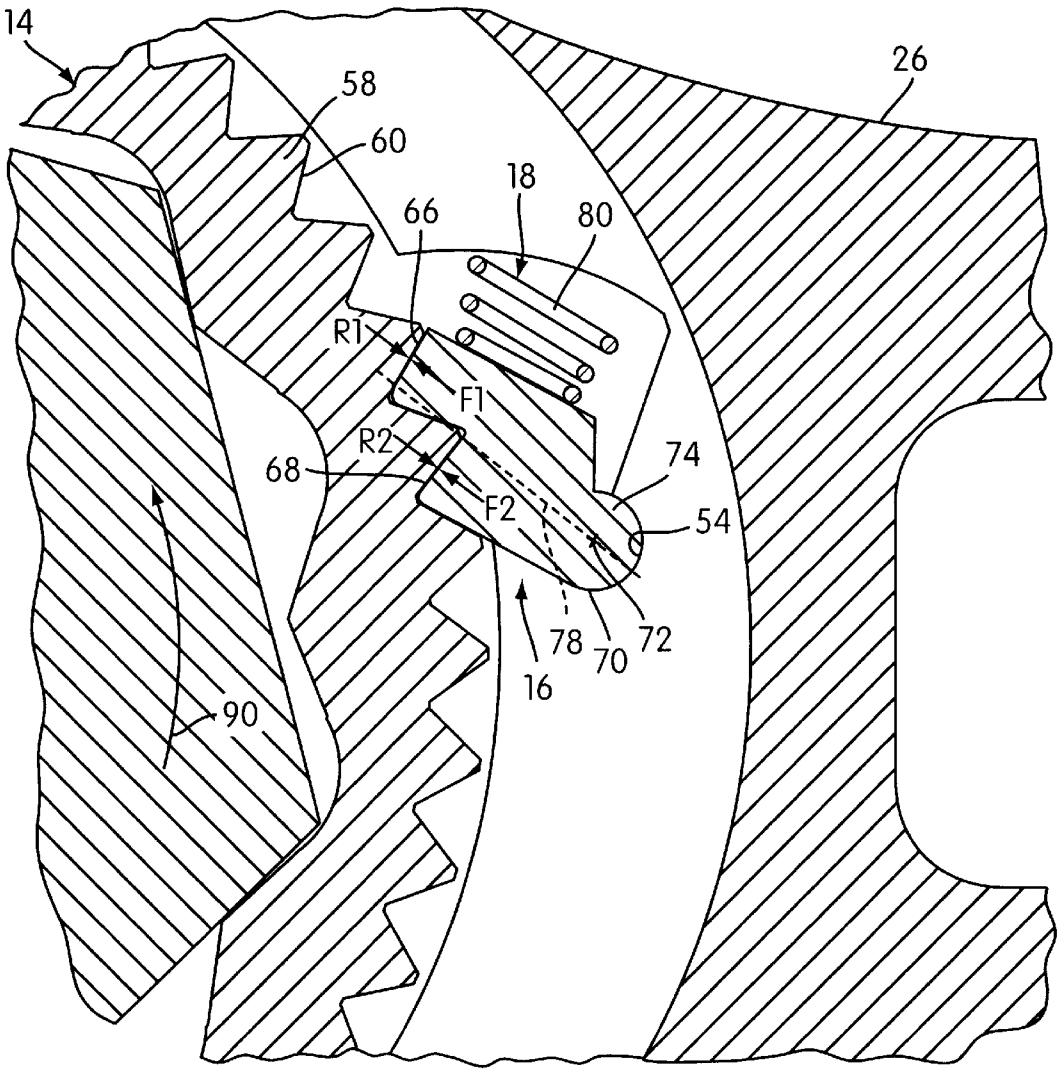
FIG. 7 is a cross-sectional view showing the engagement of the pawl and the ratchet gear when applying torque with the force being transmitted through the pawl entirely in compression.
Figure 8:
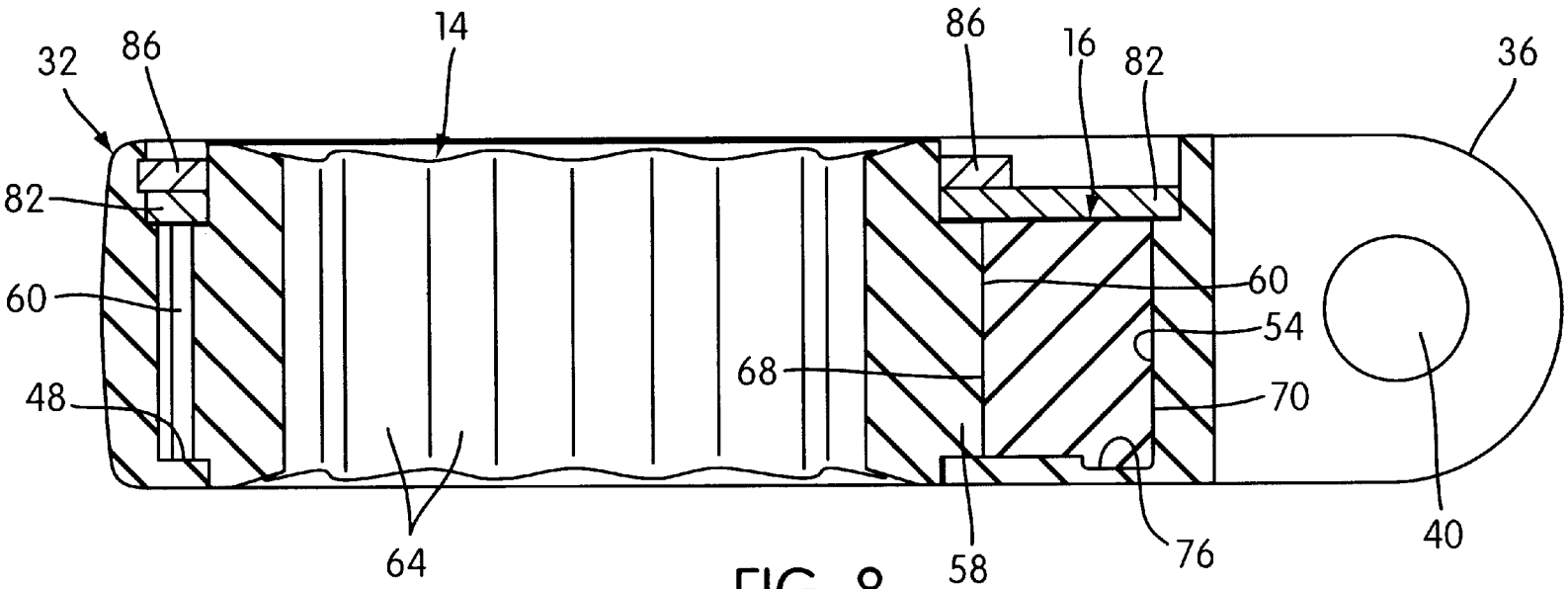
FIG. 8 is a cross-sectional view of the gear carrier with all the wrench components assembled therein as in FIG. 1

Referring now more particularly to FIG. 7, when the ratchet gear 14 is coupled to a fastener in torque transmitting relation, a manual force applied in a torque applying direction 90 to the handle portion 20 of the wrench body 12 is transmitted from the wrench body 12 to the pawl 16 via the engagement between the pawl engaging surface 54 and the load receiving surface 70. This manual force is transmitted from the pawl 16 to the ratchet gear 14 via the engagement between the first and second tooth engaging surfaces 66, 68 and the tooth surfaces 60 of the adjacent pair of the gear teeth 58 so as to apply torque to the gear 14, which torque is in turn applied to the fastener to affect rotation thereof The pawl 16 is constructed and arranged with respect to the gear teeth 58 and the pawl engaging surface 54 such that in the gear driving position thereof, a first portion $F_1$ of the manual force is transmitted through the pawl 16 from the load receiving surface 70 thereof to the first tooth engaging surface 66 thereof for application to one of the gear teeth (and hence creation of an opposite reaction force $R_1$) and a second portion $F_2$ of the manual force is transmitted through the pawl 16 from the load receiving surface thereof 70 to the second tooth engaging surface thereof 68 for application to the other of the gear teeth (and hence creation of an opposite reaction force $R_2$). The first and second portions $F_1$, $F_2$ of the manual force (and the opposite reaction forces $R_1$, $R_2$) are transmitted through the pawl 16 in a balanced relation with respect to the imaginary axis 78 extending from the pawl axis 72 so that the first and second portions $F_1$, $F_2$ of the manual force (and the opposite reaction forces $R_1$, $R_2$) offset each other about the pawl axis 72 and the pawl 16 is compressed between the pawl engaging surface 54 and the first and second tooth engaging surfaces 66, 68.

In the illustrated embodiment, the pawl 16 is supported against pivotal movement by surface 71, and thus balancing the first and second portions $F_1$, $F_2$ of the manual force (and their opposite reaction forces $R_1$, $R_2$) prevents the pawl 16 from being bent in a cantilevered manner from surface 71. This prevents the creation of the shear forces associated with such bending. It is contemplated that the pawl 16 may be spaced from surface 71 and thus unsupported. In that arrangement, the balancing of the first and second force portions will prevent pivotal movement of the pawl 16 towards surface 71.

The pawl 16 is constructed and arranged such that the second tooth engaging surface 68 is perpendicular to the imaginary axis 78 so when the pawl 16 is engaged with the gear teeth 58 the first and second portions $F_1$, $F_2$ of the manual force (and the opposite reaction forces $R_1$, $R_2$) are transmitted through the pawl parallel to the axis 78.

It is contemplated that three or more of the gear teeth 58 may be engaged with a pawl comprising three or more tooth engaging surfaces when applying torque. The pawl must be constructed and arranged so as to balance the manual force with respect to the pawl axis so pivotal movement is prevented and so the pawl is compressed between the three or more tooth engaging surfaces and the pawl engaging surface.

The pawl 16 is constructed and arranged with respect to the gear teeth 58 such that a manual force applied in a ratcheting direction to the handle portion 20 opposite the torque applying direction 90 causes rotation of the wrench body 12 relative to the ratchet gear 14 with the pawl 16 repeatedly ratcheting over the gear teeth 58 against the biasing of the biasing element 18.

The gear carrier 26 is pivotally mounted to the handle portion 20 so as to enable a position of the gear carrier 26 relative to the handle portion 20 to be selectively adjusted. The one end portion 22 of the handle portion 20 is provided with an extended portion 92 that has a transverse bore 94 therethrough. The gear carrier 26 has the pair of parallel arm members 36, 38 each having the transverse bore 40, 42 therethrough. The arm members 36, 38 are spaced so as to slidably receive the extended portion 92 therebetween with the bores 40, 42, 94 aligned so as to receive a pin, generally shown at 96, therethrough. The pin 96 has a raised central portion 98 with a plurality of grooves 100 extending across the longitudinal extent such that when the pin 96 is inserted through the bores 40, 42, 94, the central portion 98 will deform and frictionally fit within the bore 94 of the extended portion 92. Therefore, the central portion 98 of the pin 96 will be fixed within the bore 94 and the arms 36, 38 of the gear carrier 26 will rotate relative to end portions 102, 104 of the pin 96. A swivel spring 106 is located between one of the arm members 36, 38 and the extended portion 92 about the pin 96 to provide sufficient resistance to movement of the gear carrier 26 about the end portions 102, 104 of the pin 96. Thus, a secure position of the gear carrier 26 can be maintained during operation of the ratchet wrench 10.

It can thus be appreciated that the objectives of the present invention have been fully and effectively accomplished. The foregoing specific embodiments have been provided to illustrate the structural and functional principles of the present invention and is not intended to be limiting. To the contrary, the present invention is intended to encompass all modifications, alterations, and substitutions within the spirit and scope of the appended claims.

What is claimed:

1. A ratchet wrench for selectively applying torque to a fastener, said wrench comprising:

a wrench body having a handle portion configured to be manually grasped and a pawl engaging surface;

a ratchet gear constructed and arranged to be removably engaged with the fastener such that torque applied to said gear is transmitted to the fastener to effect rotation thereof, said ratchet gear being mounted to said wrench body such that said gear and said body are rotatable relative to one another about a gear axis, said ratchet gear having a plurality of gear teeth arranged on a radially outer peripheral surface thereof in circumferential relation with respect to said gear axis, each of said teeth having opposing tooth surfaces;

a pawl having first and second spaced apart tooth engaging surfaces and a load receiving surface opposite said first and second tooth engaging surfaces, said pawl being mounted to said wrench body for pivotal movement about a pawl axis with said load receiving surface thereof engaging said pawl engaging surface of said wrench body, said pawl being movable to a gear driving position wherein said first and second tooth engaging surfaces of said pawl is positioned for driving engagement with respective tooth surfaces of a pair of said gear teeth such that a manual force applied in a torque applying direction to the handle portion of said wrench body is transmitted from said wrench body to said pawl via the engagement between said pawl engaging surface and said load receiving surface and from said pawl to said ratchet gear via the engagement between said tooth engaging surfaces and the aforesaid tooth surfaces of the pair of said gear teeth so as to apply torque to said gear;

said pawl being constructed and arranged with respect to said gear teeth and said pawl engaging surface such that in said gear driving position thereof a first portion of the manual force is transmitted through said pawl from said load receiving surface thereof to said first tooth engaging surface thereof for application to one of the gear teeth and a second portion of the manual force is transmitted through said pawl from said load receiving surface to said second tooth engaging surface thereof for application to the other of the gear teeth with the first and second portions of the manual force being in a balanced relation with respect to said pawl axis so that said first and second portions of said manual force offset each other about the pawl axis and said pawl is compressed between said pawl engaging surface and said first and second tooth engaging surfaces; and a biasing element engaged with said pawl and biasing said pawl to said gear driving position, said pawl being constructed and arranged with respect to said gear teeth such that a manual force applied in a ratcheting direction to said handle portion opposite said torque applying direction causes rotation of said wrench body relative to said ratchet gear with said pawl repeatedly ratcheting over said gear teeth against the biasing of said biasing element.

2. A ratchet wrench according to claim 1, wherein said load receiving surface of said pawl has an arcuate shape and wherein said pawl engaging surface of said wrench body has an arcuate shape generally complementary to the arcuate shape of said load receiving surface.

3. A ratchet wrench according to claim 2, wherein said pawl comprises a generally cylindrical pivot pin extending therefrom at said pawl axis and wherein said wrench body comprises a generally cylindrical pivot pin receiving opening, said pivot pin providing said load receiving surface and said pivot pin receiving opening providing said pawl engaging surface.

4. A ratchet wrench according to claim 1, wherein wrench body further comprises a gear carrier that is adjustably mounted to said handle portion so as to enable a position of said gear carrier relative to said handle portion to be selectively adjusted, said ratchet gear being rotatably mounted to said gear carrier and said gear carrier providing said pawl engaging surface.

5. A ratchet wrench according to claim 4, wherein said gear carrier is pivotably mounted to said handle to allow for selective adjustment of the position of said gear carrier.

6. A ratchet wrench according to claim 1, wherein said gear carrier comprises an exterior wall extending about gear to conceal said gear teeth.

7. A ratchet wrench according to claim 1, wherein said gear has a ring-shaped wall providing the outer peripheral surface with said gear teeth, said ring-shaped wall having a fastener receiving opening defined by a plurality of fastener engaging surfaces engageable with a fastener receivable in said fastener receiving opening.

* * * * *